US010482893B2

(12) United States Patent
Daido et al.

(10) Patent No.: US 10,482,893 B2
(45) Date of Patent: Nov. 19, 2019

(54) SOUND PROCESSING METHOD AND SOUND PROCESSING APPARATUS

(71) Applicant: YAMAHA CORPORATION, Hamamatsu-shi (JP)

(72) Inventors: Ryunosuke Daido, Hamamatsu (JP); Hiraku Kayama, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 85 days.

(21) Appl. No.: 15/800,488

(22) Filed: Nov. 1, 2017

(65) Prior Publication Data

US 2018/0122397 A1 May 3, 2018

(30) Foreign Application Priority Data

Nov. 2, 2016 (JP) ..... 2016-215226

(51) Int. Cl.
*G10L 21/00* (2013.01)
*G10L 21/02* (2013.01)
*G10L 21/007* (2013.01)

(52) U.S. Cl.
CPC ..... *G10L 21/0205* (2013.01); *G10L 21/007* (2013.01)

(58) Field of Classification Search
CPC ..... G10L 15/04; G10L 19/02; G10L 19/03
USPC ..... 704/233
See application file for complete search history.

(56) References Cited

U.S. PATENT DOCUMENTS 4,956,865 A * 9/1990 Lennig ..... G10L 15/02 704/241
6,411,925 B1 * 6/2002 Keiller ..... G10L 15/20 704/200
6,711,536 B2 * 3/2004 Rees ..... G10L 15/04 704/210
2004/0006472 A1 1/2004 Kemmochi
2013/0311189 A1 11/2013 Villavicencio et al.

FOREIGN PATENT DOCUMENTS

JP 2004038071 A 2/2004
JP 2013242410 A 12/2013

* cited by examiner

*Primary Examiner* — Daniel Abebe
(74) *Attorney, Agent, or Firm* — Rossi, Kimms & McDowell LLP

(57) ABSTRACT

A sound processing method includes a step of applying a nonlinear filter to a temporal sequence of spectral envelope of an acoustic signal, wherein the nonlinear filter smooths a fine temporal perturbation of the spectral envelope without smoothing out a large temporal change. A sound processing apparatus includes a smoothing processor configured to apply a nonlinear filter to a temporal sequence of spectral envelope of an acoustic signal, wherein the nonlinear filter smooths a fine temporal perturbation of the spectral envelope without smoothing out a large temporal change.

6 Claims, 5 Drawing Sheets

SOUND PROCESSING METHOD AND SOUND PROCESSING APPARATUS

CROSS REFERENCE TO RELATED APPLICATIONS

This application is based on Japanese Patent Application (No. 2016-215226) filed on Nov. 2, 2016, the contents of which are incorporated herein by way of reference.

BACKGROUND

The present invention relates to a technology for processing an acoustic signal.

Various technologies for executing sound processing such as sound character conversion on acoustic signals have been proposed in the related art. For example, Patent Documents 1 and 2 disclose technologies for converting sound qualities by changing spectral envelopes of acoustic signals.

[Patent Document 1] JP 2004-38071 A.

[Patent Document 2] JP 2013-242410 A

SUMMARY

In the spectral envelopes of acoustic signals subjected to sound processing such as sound character conversion, there are fine temporal perturbations on time axes. To generate voices with high sound qualities, it is important to suppress the fine temporal perturbations. However, for example, in a case in which a spectral envelope is smoothed on a time axis after sound processing by a simple moving average, a change in the spectral envelope in a boundary of each phoneme becomes gentle. Therefore, there is a possibility that a voice subjected to the sound processing is perceived as an unnatural voice of bad articulation. In consideration of the foregoing circumstances, preferred aspects of the invention are to suppress a fine temporal perturbation while maintaining auditory clarity.

To resolve the foregoing problem, according to an aspect of the invention, there is provided a sound processing method including: applying a nonlinear filter to a temporal sequence of a spectral envelope of an acoustic signal, wherein the nonlinear filter smooths a fine temporal perturbation of the spectral envelope without smoothing out a large temporal change.

According to an aspect of the invention, there is provided a sound processing apparatus including a smoothing processor configured to apply a nonlinear filter to a temporal sequence of spectral envelope of an acoustic signal, wherein the nonlinear filter smooths a fine temporal perturbation of the spectral envelope without smoothing out a large temporal change.

DETAILED DESCRIPTION OF EXEMPLIFIED EMBODIMENT

Figure 1:
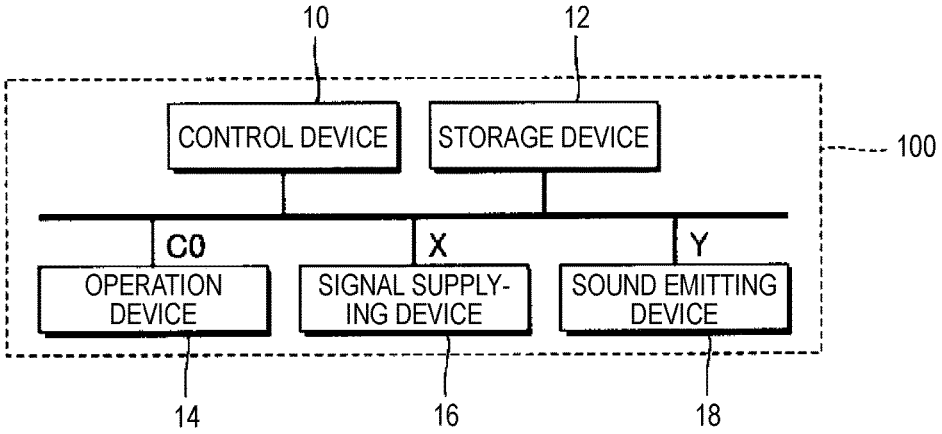
FIG. 1 is a diagram illustrating a configuration of a sound processing apparatus according to a first embodiment of the invention.

FIG. 1 is a diagram exemplifying the configuration of a sound processing apparatus 100 according to a first embodiment of the invention. As exemplified in FIG. 1, the sound processing apparatus 100 according to the first embodiment is realized by a computer system that includes a control device 10, a storage device 12, an operation device 14, a signal supplying device 16, and a sound emitting device 18. For example, an information processing apparatus such as a portable communication terminal such as mobile phone or a smartphone or a portable or stationary personal computer can be used as the sound processing apparatus 100. The sound processing apparatus 100 can be realized not only as a single apparatus but also as a plurality of apparatuses configured to be separated from each other.

The signal supplying device 16 outputs an acoustic signal X indicating a sound such as a voice or a musical sound. Specifically, a sound collection device that collects a surrounding sound and generates an acoustic signal X, a reproduction device that acquires the acoustic signal X from a portable or built-in recording medium, or a communication device that receives the acoustic signal X from a communication network can be used as the signal supplying device 16. In the first embodiment, a case in which the signal supplying device 16 generates the acoustic signal X representing a voice (for example, a singing voice spoken through singing of music) produced by a person who produces a voice will be assumed.

The sound processing apparatus 100 according to the first embodiment is a signal processing apparatus that generates the acoustic signal Y obtained by executing sound processing on the acoustic signal X. The sound emitting device 18 (for example, a speaker or a headphone) emits a sound wave according to the acoustic signal Y. A D/A converter that converts the acoustic signal Y from a digital signal to an analog signal and an amplifier that amplifies the acoustic signal Y are not illustrated for convenience.

The operation device 14 is an input device that receives an instruction from a user. For example, a plurality of operators operated by a user or a touch panel that detects a touch by the user is used appropriately as the operation device 14. The user can designate a numerical value (hereinafter referred to as an instruction value) CO indicating the degree of sound processing by the sound processing apparatus 100 by appropriately operating the operation device 14.

The control device 10 is configured to include, for example, a processing circuit such as a central processing unit (CPU) and generally controls each element of the sound processing apparatus 100. The storage device 12 stores programs which are executed by the control device 10 and various kinds of data which are used by the control device 10. Any known recording medium such as a semiconductor recording medium and a magnetic recording medium or any combination of a plurality of kinds of recording media can be adopted as the storage device 12. A configuration in which the acoustic signal X is stored in the storage device 12 (accordingly, the signal supplying device 16 can be omitted) is also suitable.

Figure 2:
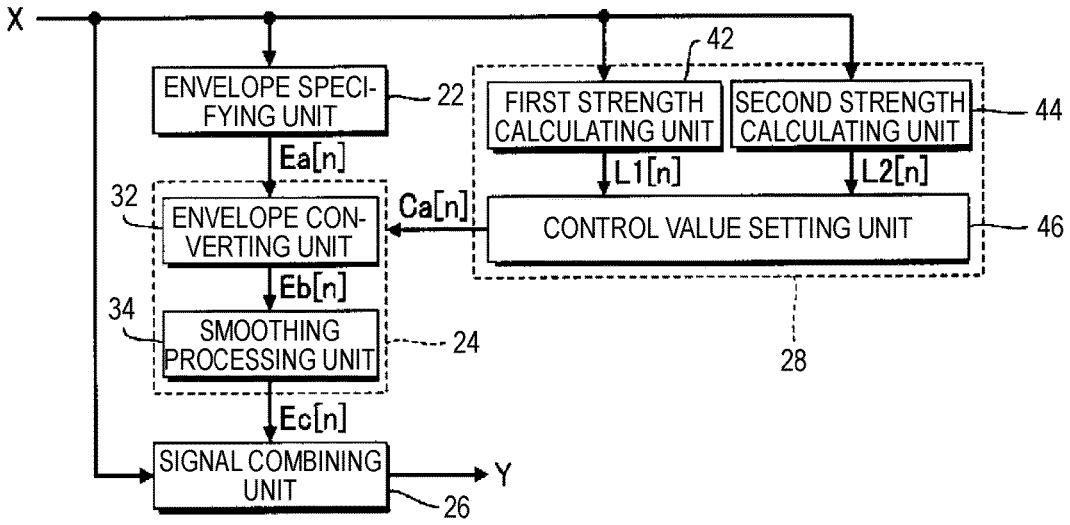
FIG. 2 is a diagram illustrating a configuration in which functions of the sound processing apparatus are focused.

FIG. 2 is a diagram illustrating a configuration in which functions of the sound processing apparatus 100 are focused. As exemplified in FIG. 2, the control device 10 executes a program stored in the storage device 12 to realize a plurality of functions of generating the acoustic signal Y from the acoustic signal X (an envelope specifying unit 22, a sound processing unit 24, a signal combining unit 26, and a control processing unit 28). Either a configuration in which the functions of the control device 10 are distributed to a plurality of devices or a configuration in which some or all of the functions of the control device 10 are realized by a dedicated electronic circuit can be adopted.

Figure 3:
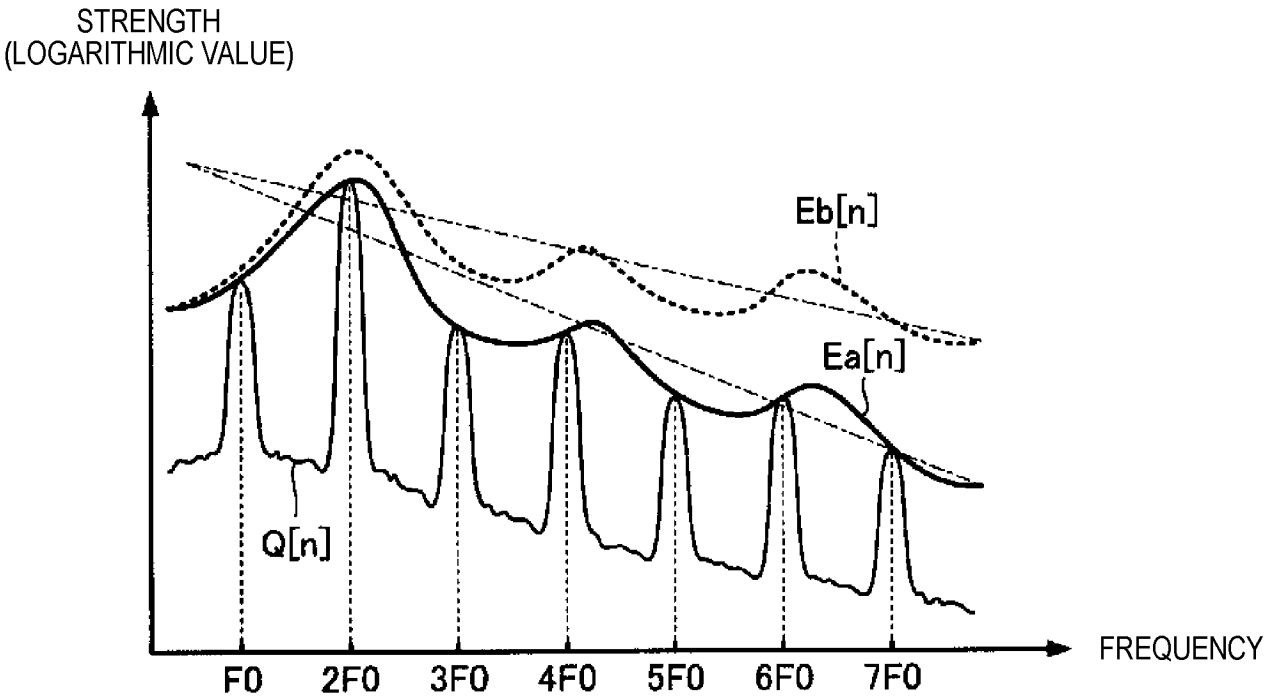
FIG. 3 is an explanatory diagram illustrating a spectral envelope of an acoustic signal.

The envelope specifying unit 22 specifies a spectral envelope Ea[n] of the acoustic signal X at each of a plurality of time points (hereinafter referred to as "analysis time points") on a time axis. The n is a variable indicating one arbitrary analysis time point. As exemplified in FIG. 3, the spectral envelope Ea[n] at one arbitrary time point n is an envelope line indicating an outline of a frequency spectrum Q[n] of the acoustic signal X. Any known analysis process is adopted to calculate the spectral envelope Ea[n]. In the first embodiment, a cepstrum technique is used. That is, one spectral envelope Ea[n] is expressed as, for example, a predetermined number (M) of cepstrum coefficients on a low-order side among a plurality of cepstrum coefficients calculated from the acoustic signal X.

The sound processing unit 24 in FIG. 2 generates a spectral envelope Ec[n] at each time point n through sound processing on the spectral envelope Ea[n] specified at each time point n by the envelope specifying unit 22. The spectral envelope Ec[n] is an envelope line obtained by deforming the shape of the spectral envelope Ea[n]. As exemplified in FIG. 2, the sound processing unit 24 according to the first embodiment includes an envelope converting unit 32 and a smoothing processing unit 34.

The envelope converting unit 32 executes a process of converting a sound character of the voice represented by the acoustic signal X (hereinafter referred to as "sound character conversion"). The sound character conversion according to the first embodiment is a process of converting the spectral envelope Ea[n] generated by the envelope specifying unit 22 to generate a spectral envelope Eb[n] with a voice with a different sound character from the acoustic signal X. The envelope converting unit 32 according to the first embodiment generates the spectral envelope Eb[n] in sequence at each time point n by changing a gradient of the spectral envelope Ea[n] at each time point n, as exemplified in FIG. 3. The gradient of the spectral envelope Ea[n] or Eb[n] means an angle (a rate of change with respect to a frequency) of a straight line representing the outline of the envelope line, as indicated by a chain line in FIG. 3.

For example, the spectral envelope Eb[n] representing a voice sound of clear tension is obtained by strengthening a high-frequency component of the spectral envelope Ea[n] (that is, by flattening the gradient of the envelope to some extent). The spectral envelope Eb[n] representing a soft voice sound of suppressed tension is obtained by weakening a high-frequency component of the spectral envelope Ea[n] (that is, by steepening the gradient of the envelope line to some extent). The degree of the sound character conversion by the envelope converting unit 32 (the degree of a difference between the spectral envelope Ea[n] and the spectral envelope Eb[n]) is controlled according to a control value Ca[n]. The details of the control value Ca[n] will be described below.

Incidentally, in a case in which a voice represented by the acoustic signal X is converted into a voice sound of clear tension, a breath component (typically, an inharmonic component) of a soft voice before the conversion can be emphasized. The breath component tends to vary irregularly and frequently on a time axis since the breath component is pronounced probabilistically. Accordingly, due to the process of converting a voice into a voice with the sound character of clear tension, a fine temporal perturbation can occur on the time axis in a time series of the plurality of spectral envelopes Eb[n]. Due to an estimation error of the spectral envelope Ea[n] by the envelope specifying unit 22, a fine temporal perturbation can also be on the time axis in some cases in a time series of the spectral envelopes Eb[n] generated at analysis time points by the envelope converting unit 32. As described above, a fine temporal perturbation can be on the time axis in a time series of the plurality of spectral envelopes Eb[n] generated by the envelope converting unit 32. To suppress the fine temporal perturbation of the spectral envelopes Eb[n] exemplified above, the smoothing processing unit 34 in FIG. 2 generates the spectral envelope Ec[n] at each time point n in sequence by smoothing the spectral envelope Eb[n] converted by the envelope converting unit 32 on the time axis.

Specifically, the smoothing processing unit 34 according to the first embodiment generates the spectral envelope Ec[n] by executing a smoothing process on each spectral envelope Eb[n] generated at each time point n by the envelope converting unit 32, using a nonlinear filter. The nonlinear filter according to the first embodiment is an epsilon (c) separation type nonlinear filter. The epsilon separation type nonlinear filter is expressed by, for example, Equations (1) and (2) below.

$$Vc[n] = Vb[n] - \sum_{k=-K}^{K} a[k]F[k] \tag{1}$$

$$F[k] = \begin{cases} Vb[n] - Vb[n-k] & (D(Vb[n], Vb[n-k]) < \varepsilon) \\ 0 & \text{otherwise} \end{cases} \tag{2}$$

Equation (1) indicates a non-recursive type digital filter using a plurality of coefficients a[k]. One spectral envelope in frequency domain is expressed with M cepstrum coefficients. Specifically, in Equation (1), Vb[n] is an M-dimensional vector in which one spectral envelope Eb[n] is expressed with M cepstrum coefficients. Vc[n] is an M-dimensional vector in which one smoothed spectral envelope Ec[n] is expressed with M cepstrum coefficients. In Equation (1), K− is a positive number indicating the number of spectral envelopes Eb[n'] just before a time point n and K+ is a positive number indicating the number of spectral envelopes Eb[n"] just after the time point n, and both of spectral envelopes Eb[n'] and Eb[n"] are used to calculate a smoothed spectral envelope Ec[n] at the time point n. In Equation (1), F[k] is a nonlinear function expressed in Equation (2).

An arithmetic operation of Equation (1) indicates filter processing executed to generate a spectral envelope Ec[n] (Vc[n]) through a product-sum arithmetic operation of calculating a nonlinear function F[k] corresponding to each of the spectral envelopes Eb[n-k] (Vb[n−k]) on periphery of the spectral envelope Eb[n] at time point n on the time axis, multiplying each of the nonlinear functions F[k] by a coefficient a[k] and accumulating the products. The spectral envelope Eb[n] expressed with a vector Vb[n] is an example of a first spectral envelope and the spectral envelope Eb[n−k] expressed with a vector Vb[n−k] is an example of a second spectral envelope. The spectral envelope Ec[n] expressed by a vector Vc[n] which is a result of the arithmetic operation of Equation (1) is an example of an output spectral envelope.

In Equation (2), D (Vb[n], Vb[n−k]) is an index representing the degree of similarity or difference between the n-th spectral envelope Eb[n] and the (n−k)-th spectral envelope Eb[n−k] (hereinafter referred to as "similarity index"). Concretely, as expressed in Equation (3a) below, a norm (distance) between the vector Vb[n] and the vector Vb[n−k] is one example of the similarity index D (Vb[n], Vb[n−k]). In Equation (3a), T means a transposition of a vector. As an other example expressed in Equation (3b), a difference |Vb[n]_m−Vb[n−k]_m| of elements for each dimension between the vector Vb[n] and the vector Vb[n−k] may be calculated (where m=0 to M−1) and a maximum value (max) of M differences |Vb[n]_m−Vb[n−k]_m| may also be used as the similarity index D (Vb[n], Vb[n-k]). In Equation (3b), Vb[n]_m means an m-th element (that is, an m-th cepstrum coefficient) among M elements of the vector Vb[n]. As understood from Equations (3a) and (3b), in the first embodiment, as the spectral envelope Eb[n] and the spectral envelope Eb[n−k] are more similar each other, the similarity index D (Vb[n], Vb[n−k]) has a smaller numerical value.

$$D(Vb[n], Vb[n-k]) = \sqrt{(Vb[n] - Vb[n-k])^T \cdot (Vb[n] - Vb[n-k])} \tag{3a}$$

$$D(Vb[n], Vb[n-k]) = \max_{m=0}^{M-1} |\mathrm{Vb[n]_m} - \mathrm{Vb[n-k]_m}| \tag{3b}$$

As expressed in Equation (2) described above, in a case in which the similarity index D (Vb[n], Vb[n−k]) is less than a threshold ε (that is, a case in which the similarity index expresses high similarity between the spectral envelope Eb[n] and the spectral envelope Eb[n−k]), the difference vector (Vb[n]−Vb[n−k]) between the spectral envelope Eb[n] and the spectral envelope Eb[n−k] is used as the nonlinear function F[k] of Equation (1). Conversely, in a case in which the similarity index D (Vb[n], Vb[n−k]) is greater than the threshold c (that is, a case in which the similarity index expresses big difference (low similarity) between the spectral envelope Eb[n] and the spectral envelope Eb[n−k]), the nonlinear function F[k] is set to a zero vector. That is, the spectral envelope Eb[n−k] in which the similarity index D (Vb[n], Vb[n−k]) is greater than the threshold c is excluded so as not to affect the result of the product-sum arithmetic operation of Equation (1). Accordingly, the smoothing process in which the epsilon separation type nonlinear filter of Equation (1) is operated so that a fine temporal perturbation in the spectral envelope Eb[n] is smoothed and the smoothing on a large temporal change is suppressed. The epsilon separation type nonlinear filter of Equation (1) is also said to be a filter that performs temporal smoothing on the spectral envelope Eb[n] while suppressing the difference |Vb[n]−Vc[n]| between the spectral envelope Eb[n] before the smoothing and the spectral envelope Ec[n] after the smoothing within a predetermined range.

Figure 4:
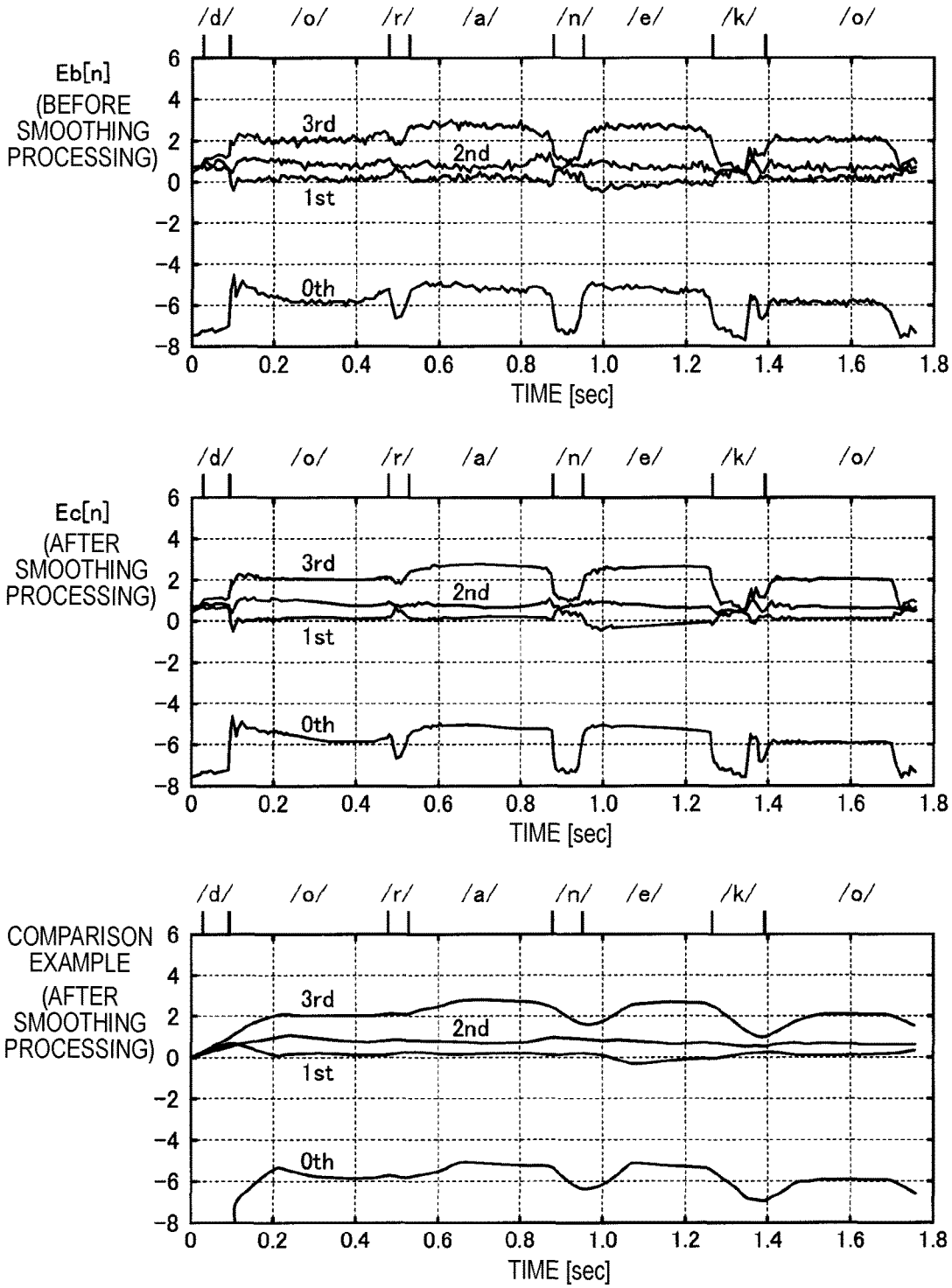
FIG. 4 is a graph illustrating temporal changes of the spectral envelope before and after a smoothing process.

A top graph in FIG. 4 illustrates a temporal change of the spectral envelope Eb[n] before the smoothing process and a middle graph illustrates a temporal change of the spectral envelope Ec[n] after the smoothing process by the epsilon separation type nonlinear filter in Equation (1). Each graph in FIG. 4 illustrates the temporal changes in 0th to third (where m=0 to 3) cepstrum coefficients. A bottom graph in FIG. 4 illustrates, as a comparison example, a temporal change of the spectral envelope Ec[n] after smoothing process on the spectral envelope Ec[n] by a simple time average (simple average) filter. Each graph in FIG. 4 has boundaries (each indicated by a vertical line) of phonemes of a voice represented by the acoustic signal X on the upper side.

As understood from FIG. 4, a fine temporal perturbation of the spectral envelope Eb[n] is suppressed in both of the first embodiment and the comparison example. However, in the comparison example, the temporal change of the spectral envelope Ec[n] in the boundary of each phoneme is suppressed to be gentle in comparison to the temporal change of the spectral envelope Eb[n] before the process. Accordingly, a voice of the spectral envelope Ec[n] in the comparison example is likely to be perceived auditorily as an unnatural voice of bad articulation.

In contrast to the comparison example, according to the first embodiment in which the epsilon separation type nonlinear filter is used, as confirmed from FIG. 4, a change in the spectral envelope Ec[n] in the boundary of each phoneme is maintained to be substantially equal to a temporal change of the spectral envelope Eb[n] before the smoothing process. That is, according to the first embodiment, it is possible to effectively smooth the fine temporal perturbation of the spectral envelope Eb[n] while maintaining the steep temporal change of the spectral envelope Ec[n] after the smoothing process to be equal to the temporal change before the smoothing process (that is, while maintaining articulation perceived a listener).

Incidentally, as understood from FIG. 4, process delay caused due to the smoothing process considerably occurs in the spectral envelope Ec[n] in the comparison example. That is, the time series of the spectral envelopes Ec[n] generated in the comparison example has a delay relation with respect to the spectral envelope Eb[n] before the process. In contrast to the comparison example, according to the first embodiment in which the epsilon separation type nonlinear filter is used, as confirmed from FIG. 4, there is the advantage that delay caused due to the smoothing process by the smoothing processing unit 34 does not occur mostly. From the viewpoint of reducing the process delay of the smoothing process, a configuration in which a constant K+ in Equation (1) is set to a sufficiently small positive number or zero is suitable.

The signal combining unit 26 in FIG. 2 generates the acoustic signal Y by adjusting the acoustic signal X using the spectral envelope Ec[n] generated at each time point n by the sound processing unit 24. Specifically, the signal combining unit 26 generates the acoustic signal Y having the spectral envelope Ec[n] by adjusting the acoustic signal X having the spectral envelope Ea[n] such that the frequency spectrum Q[n] of the acoustic signal X is modified to be consistent with the spectral envelope Ec[n] after the sound processing. That is, the spectral envelope Ea[n] of the acoustic signal X is changed to the spectral envelope Ec[n] by the sound processing.

The control processing unit 28 in FIG. 2 sets the control value Ca[n] indicating the degree of the sound processing by the sound processing unit 24. The control processing unit 28 according to the first embodiment sets the above-described control value Ca[n] indicating the degree of the sound character conversion by the envelope converting unit 32. In the first embodiment, a case in which as the control value Ca[n] is smaller, the sound character conversion is suppressed is assumed.

When the same sound character conversion as that during a period in which a vowel is normally maintained is executed during a period in which a volume is relatively small, such as a period in which a voiced constant is pronounced in the acoustic signal X or a period in which a vowel phoneme transitions, there is a possibility that the converted voice is perceived as a unnatural voice of bad articulation. In consideration of the foregoing circumstance, the control processing unit 28 according to the first embodiment sets the control value Ca[n] so that the degree of the sound character conversion is suppressed during a period in which a level in the acoustic signal X is small. As exemplified in FIG. 2, the control processing unit 28 according to the first embodiment includes a first strength calculating unit 42, a second strength calculating unit 44, and a control value setting unit 46.

Figure 5:
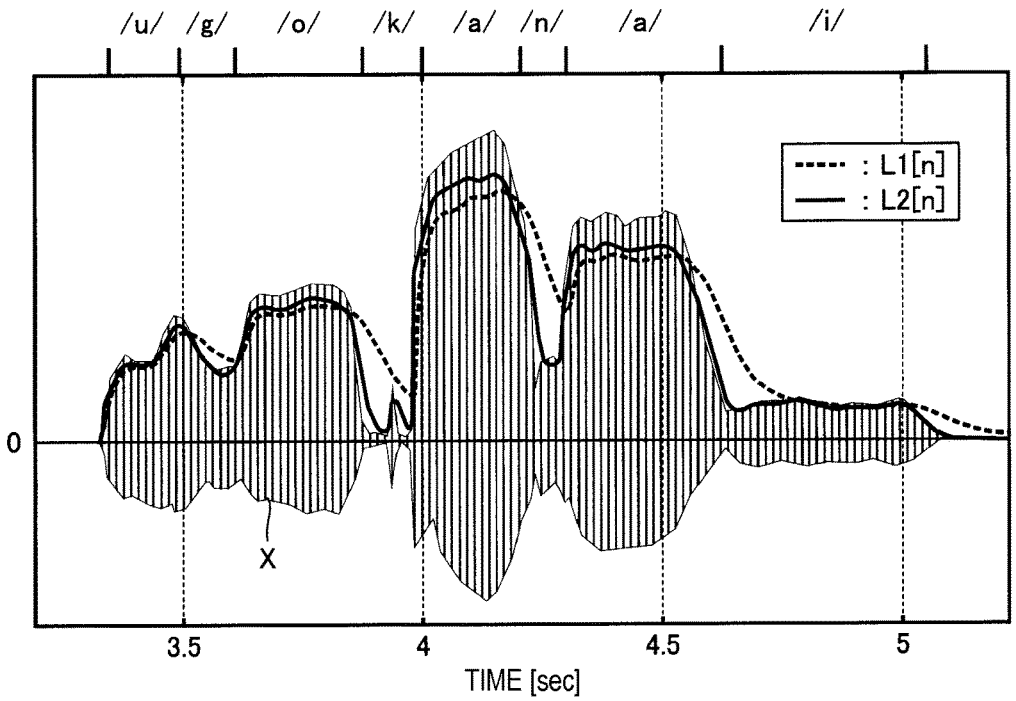
FIG. 5 is an explanatory diagram illustrating a relation between an acoustic signal and a strength of the acoustic signal.

FIG. 5 is an explanatory diagram illustrating operations of the first strength calculating unit 42 and the second strength calculating unit 44. As exemplified in FIG. 5, the first strength calculating unit 42 calculates a strength L1[n] (an example of a first strength) following a temporal change of a level (for example, a volume, an amplitude, or power) of the acoustic signal X at each analysis time point n in sequence. The second strength calculating unit 44 calculates a strength L2[n] (an example of a second strength) following the temporal change of the level of the acoustic signal X with higher a following nature than the strength L1[n] at each analysis time point n in sequence. The strengths L1[n] and L2[n] are numerical values related to the level of the acoustic signal X. In the above description, the following nature of the level of the acoustic signal X has been focused on. However, it can also be said that the first strength calculating unit 42 calculates the strength L1[n] by smoothing the acoustic signal X by a time constant τ1 and the second strength calculating unit 44 calculates the strength L2[n] by smoothing the acoustic signal X by a time constant τ2 (τ2<τ1) less than the time constant τ1.

Figure 6:
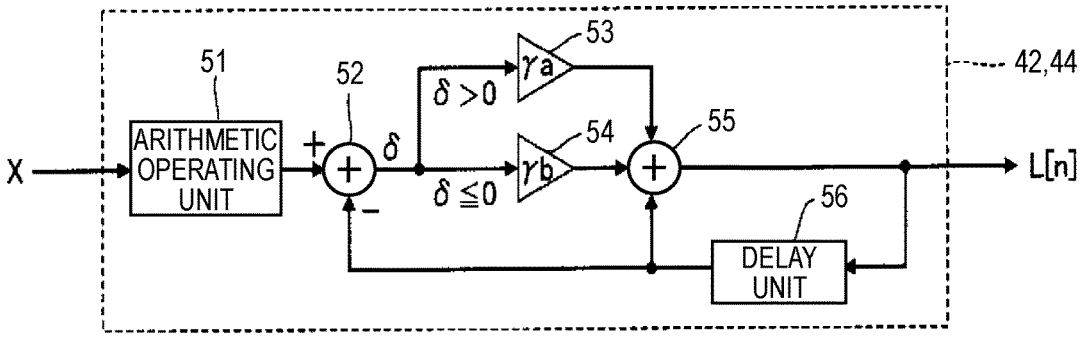
FIG. 6 is a diagram illustrating a configuration of a first strength calculating unit and a second strength calculating unit.

FIG. 6 is a diagram illustrating the configuration of the first strength calculating unit 42 and the second strength calculating unit 44. Each of the first strength calculating unit 42 and the second strength calculating unit 44 has the configuration illustrated in FIG. 6. The first strength calculating unit 42 calculates the strength L1[n] from the acoustic signal X and the second strength calculating unit 44 calculates the strength L2[n] from the acoustic signal X. In FIG. 6, the strength is written as the strength L[n] for convenience without distinguishing the strengths L1[n] and L2[n] from each other.

Each of the first strength calculating unit 42 and the second strength calculating unit 44 is an envelope follower that outputs a time series of the strength L[n] following the level of the acoustic signal X (that is, a temporal change of the volume) and includes an arithmetic operating unit 51, a subtracting unit 52, a multiplying unit 53, a multiplying unit 54, an adding unit 55, and a delay unit 56, as exemplified in FIG. 6. The delay unit 56 delays the strength L[n]. The arithmetic operating unit 51 calculates an absolute value |X| of the level of the acoustic signal X and the subtracting unit 52 subtracts the length L[n] delayed by the delay unit 56 from the absolute value |X| of the level of the acoustic signal X. In a case in a difference value δ (δ=|X|−L[n]) calculated by the subtracting unit 52 is a positive value, the multiplying unit 53 multiplies the difference value δ by a coefficient γa. In a case in which the difference value δ is a negative number, the multiplying unit 54 multiplies the difference value δ by a coefficient γb. When the adding unit 55 adds an output of the multiplying unit 53, an output of the multiplying unit 54, and the strength L[n] delayed by the delay unit 56, the strength L[n] is calculated. The time constant τ1 of the first strength calculating unit 42 and the time constant τ2 of the second strength calculating unit 44 are set to numerical values according to the coefficients γa and γb.

As understood from FIG. 5, there is a tendency that the strength L1[n] is greater than the strength L2[n] (L1[n]>L2[n]) for a period in which the level of the acoustic signal X is small and the strength L1[n] is less than the strength L2[n] (L1[n]<L2[n]) for a period in which the level of the acoustic signal X is large. In consideration of the foregoing tendency, the control value setting unit 46 according to the first embodiment sets the control value Ca[n] according to the strengths L1[n] and L2[n] so that the control value Ca[n] in the case in which the strength L1[n] is greater than the strength L2[n] has a smaller value (that is, a numerical value for suppressing the sound character conversion) than the control value Ca[n] in the case in which the strength L1[n] is less than the strength L2[n].

Specifically, the control value setting unit 46 calculates the control value Ca[n] through an arithmetic operation of Equation (4) below.

$$Ca[n] = C0 \cdot \left\{1 - \max\left(\frac{L1[n] - L2[n]}{L\max}, 0\right)\right\} \tag{4}$$

In Equation (4), Lmax is a numerical value of a larger one of the strengths L1[n] and L2[n]. An operation max (a, b) means a maximum value arithmetic operation of selecting a larger one of numerical values a and b. As understood from Equation (4), in a case in which the strength L1[n] is less than the strength L2[n] (the level of the acoustic signal X is large), the difference (L1[n]−L2[n]) between the strengths is a negative value. Therefore, 0 is selected in the maximum value arithmetic operation. Accordingly, the instruction value CO designated by the user operating the operation device 14 is set as the control value Ca[n] (Ca[n]=CO). Conversely, when the strength L1[n] is greater than the strength L2[n] (the level of the acoustic signal X is small), the difference (L1[n]−L2[n]) between the strengths is a positive value. Therefore, the difference (L1[n]−L2[n]) is selected in the maximum value arithmetic operation. Accordingly, the control value Ca[n] is set to a numerical value obtained by multiplying the instruction value CO by a positive number less than 1 (1−(L1[n]−L2[n])/Lmax). That is, the control value Ca[n] is set to a numerical value less than the instruction value C0 (Ca[n]<C0). The control value Ca[n] is set to a smaller numerical value as the strength L1[n] is larger than the strength L2[n]. As understood from the above description, the control value Ca[n] is set so that the degree of the sound character conversion is suppressed for the period in which the level of the acoustic signal X is small.

As described above, in the first embodiment, since the control value Ca[n] is set according to the difference between the strengths L1[n] and L2[n], it is not necessary to set a threshold for dividing the acoustic signal X according to a strength and the control value Ca[n] to be applied to the sound processing (the sound character conversion in the first embodiment) can be appropriately set. In the first embodiment, the control value Ca[n] in the case in which the strength L1[n] is greater than the strength L2[n] is set the numerical value for suppressing the sound character conversion in comparison to the control value Ca[n] in the case in which the strength L1[n] is less than the strength L2[n].

Accordingly, it is possible to generate an auditorily natural voice for which the sound character conversion is suppressed for a period in which a volume is small.

Figure 7:
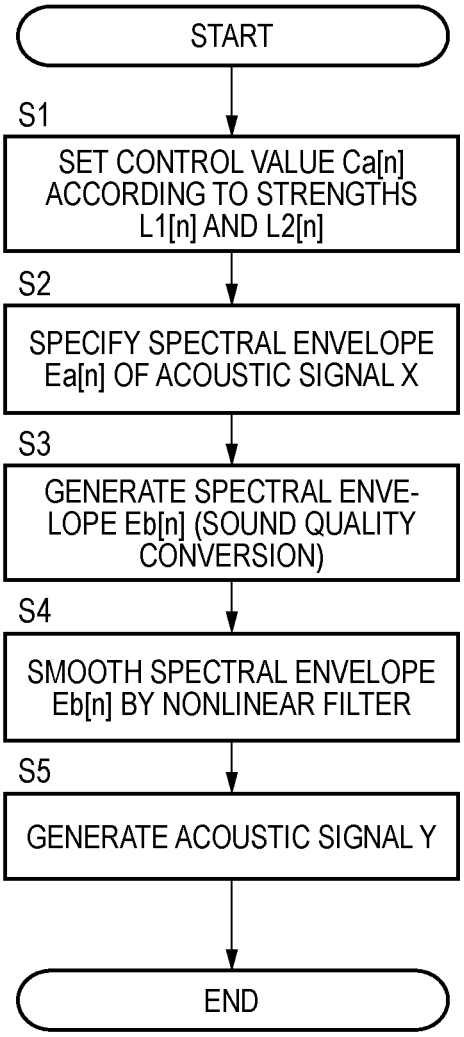
FIG. 7 is a flowchart illustrating a process executed by a control device.

FIG. 7 is a flowchart illustrating a process executed by the control device 10 according to the first embodiment. For example, the process of FIG. 7 starts using an instruction from the user on the operation device 14 as an opportunity and is repeated at each analysis time point n on the time axis.

When the process of FIG. 7 starts, the control processing unit 28 sets the control value Ca[n] according to the difference between the strengths L1[n] and L2[n] following the level of the acoustic signal X (S1). The envelope specifying unit 22 specifies the spectral envelope Ea[n] of the acoustic signal X (S2). The envelope converting unit 32 generates the spectral envelope Eb[n] obtained by deforming the spectral envelope Ea[n] specified by the envelope specifying unit 22 through the sound character conversion to which the control value Ca[n] set by the control processing unit 28 is applied (S3). The smoothing processing unit 34 generates the spectral envelope Ec[n] by executing the filter processing on the spectral envelope Eb[n] by the epsilon separation type nonlinear filter expressed in Equations (1) and (2) (S4). The signal combining unit 26 generates the acoustic signal Y by adjusting the acoustic signal X using the spectral envelope Ec[n] generated by the sound processing unit 24 (S5).

A second embodiment of the invention will be described. The reference numerals and signs used to describe the first embodiment are used for the same elements as those of the first embodiment in operational effects or functions in each embodiment to be exemplified below and the detailed description thereof will be appropriately omitted.

In the first embodiment, the control value Ca[n] used to control the degree of the sound character conversion by the envelope converting unit 32 has been set by the control processing unit 28. The control processing unit 28 according to the second embodiment sets a control value Cb[n] used to control a threshold c which is applied to the epsilon separation type nonlinear filter. That is, the threshold c according to the second embodiment is a variable value.

As understood from Equation (2) described above, as the threshold c is smaller, the similarity index D (Vb[n], Vb[n−k]) is greater than the threshold e in many cases. As described above, the spectral envelope Eb[n−k] in which the similarity index D (Vb[n], Vb[n−k]) is greater than the threshold e is excluded from a target of the product-sum arithmetic operation of Equation (1). Accordingly, as the threshold e is smaller, the spectral envelope Ec[n] after the smoothing process is closer to the spectral envelope Eb[n] before the smoothing process. That is, as the threshold e is smaller, the degree of the smoothing process is reduced.

On the other hand, since it is difficult to auditorily perceive the fine temporal perturbation in the spectral envelope Eb[n] for a period in which the level of the acoustic signal X is small, it is preferable to suppress the degree of the smoothing process executed to suppress the fine temporal perturbation. In consideration of the foregoing circumstance, the control processing unit 28 according to the second embodiment sets the control value Cb[n] so that the degree of the smoothing process using the nonlinear filter is suppressed for a period in which the level of the acoustic signal X is small.

Specifically, the control processing unit 28 sets the control value Cb[n] according to the difference between the strengths L1[n] and L2[n] following the level of the acoustic signal X. For example, as in Equation (4) described above, the control value Ca[n] according to the strengths L1[n] and L2[n] is set so that the control value Cb[n] in the case in which the strength L1[n] is greater than the strength L2[n] (for a period in which the level is small) has a smaller value than the control value Cb[n] in the case in which the strength L1[n] is less than the strength L2[n]. The control processing unit 28 sets the control value Cb[n] as the threshold e. Accordingly, for the period in which the level of the acoustic signal X is small, the threshold e is set to a small numerical value so that the smoothing process is suppressed. Conversely, for the period in which the level of the acoustic signal X is large, the threshold e is set to a large numerical value so that the sufficient smoothing process is executed. It is also possible to calculate the threshold e through a predetermined arithmetic operation on the control value Cb[n].

In the second embodiment, the same advantages as those of the first embodiment are also realized. In the second embodiment, in particular, the control value Cb[n] in the case in which the strength L1[n] is greater than the strength L2[n] is set to the numerical value for suppressing the smoothing process to the control value Cb[n] in the case in which the strength L1[n] is less than the strength L2[n]. Accordingly, it is possible to generate an auditorily natural voice for which the smoothing process is suppressed for a period in which the level is small.

In the second embodiment, the control of the smoothing process has been focused on. However, it is also possible to adopt both the control of the sound character conversion exemplified in the first embodiment and the control of the smoothing process exemplified in the second embodiment. As understood from the above description, the control processing unit 28 is comprehensively expressed as an element controlling the sound processing by the sound processing unit 24. The sound processing includes the sound character conversion by the envelope converting unit 32 and the smoothing process by the smoothing processing unit 34.

In the first embodiment, the control value Ca[n] has been calculated through the arithmetic operation of Equation (4) described above over the whole period of the acoustic signal X. However, there is a tendency that acoustic characteristics are considerably different between a period in which a voiced sound is predominant in the acoustic signal X (hereinafter referred to as a "voiced sound period") and a period other than the voiced sound period (Hereinafter referred to as a "non-voiced sound period"). Accordingly, the control of the sound processing (that is, setting of the control value Ca[n]) is preferably set to be different between the voiced sound period and the non-voiced sound period. In consideration of the foregoing circumstance, in the third embodiment, the setting of the control value Ca[n] is set to be different between the voiced sound period and the non-voiced sound period. The non-voiced sound period includes, for example, a voiceless sound period in which there are a voiceless sound, and a silence period in which a meaningful volume is not measured.

Specifically, the control value setting unit 46 of the control processing unit 28 according to the third embodiment divides the acoustic signal X into the voiced sound period and non-voiced sound period on the time axis. Any known technology can be adopted to divide the acoustic signal X into the voiced sound period and non-voiced sound period. For example, the control value setting unit 46 demarcates a period in which a definite harmonic structure is measured in the acoustic signal X (for example, a period in which a basic frequency can be definitely specified) as the voiced sound period and demarcates a voiceless period in which a harmonic structure is not definitely specified and a silence period in which a volume is less than a threshold as the non-voiced sound period. Then, the control value setting unit 46 calculates the control value Ca[n] through the arithmetic operation of Equation (5) below in which the voiced sound period and the non-voiced period are divided.

$$Ca[n] = \begin{cases} C0 \cdot \left\{1 - \max\left(\frac{L1[n] - L2[n]}{L\max}, 0\right)\right\} & \text{(Voiced Sound Period)} \\ 0 & \text{(Non-voiced Sound Period)} \end{cases} \quad (5)$$

As understood from Equation (5), the control processing unit 28 (the control value setting unit 46) according to the third embodiment sets the control value Ca[n] according to the difference between the strengths L1[n] and L2[n] for the voiced sound period of the acoustic signal X as in the first embodiment. The envelope converting unit 32 executes the sound character conversion according to the control value Ca[n] set by the control processing unit 28. On the other hand, for the non-voiced sound period of the acoustic signal X, the control processing unit 28 (the control value setting unit 46) sets the control value Ca[n] to zero. Accordingly, for the non-voiced sound period, the sound character conversion by the envelope converting unit 32 is omitted.

In the third embodiment, the same advantages as those of the first embodiment are also realized. In the third embodiment, in particular, the sound character conversion is omitted for the non-voiced sound period. Therefore, there is the advantage that an auditorily natural sound can be generated compared to a configuration in which the sound character conversion is executed uniformly without dividing the acoustic signal X into the voiced sound period and the non-voiced sound period.

In the above description, the configuration in which the acoustic signal X is divided into the voiced sound period and the non-voiced sound period in the setting of the control value Ca[n] related to the sound character conversion has been exemplified. However, the acoustic signal X can also be divided into the voiced sound period and the non-voiced sound period in the setting of the control value Cb[n] (the threshold e) of the smoothing process exemplified in the second embodiment.

The above-exemplified aspects can be modified in various forms. Specific modification aspects will be exemplified below. Two or more aspects arbitrarily selected from the following examples can be appropriately combined within the scope in which the aspects are not contradictive.

(1) In the above-described embodiments, as in Equation (2) described above, in the case in which the similarity index D (Vb[n], Vb[n−k]) is greater than the threshold e, the nonlinear function F[k] has been set to a zero vector. However, a process in the case in which the similarity index D (Vb[n], Vb[n−k]) is greater than the threshold e is not limited to the above-exemplified process. Specifically, a result obtained by suppressing the difference (Vb[n]−Vb[n−k]) between the spectral envelope Eb[n] and the spectral envelope Eb[n−k] can also be used as the nonlinear function F[k]. For example, a result obtained by multiplying the difference (Vb[n]−Vb[n−k]) by a sufficiently small positive number a (for example, 0.01) used as the nonlinear function F[k]. As understood from the foregoing example, when the similarity index D (Vb[n], Vb[n−k]) is greater than the threshold e, the smoothing processing unit 34 may use the zero vector (exclusion of the spectral envelope Eb[n−k]) as the nonlinear function F[k] in which, or may use the suppressed vector (Vb[n]−Vb[n−k])×α obtained by suppressing the difference vector (Vb[n]−Vb[n−k]) as the nonlinear function F[k].

(2) In the third embodiment, the sound character conversion for the non-voiced sound period of the acoustic signal X has been omitted. However, for the non-voiced sound period of the acoustic signal X, it is possible to suppress the sound character conversion in comparison to the voiced sound period. For example, for the non-voiced sound period of the acoustic signal X, the control processing unit 28 calculates the control value Ca[n] by multiplying the instruction value CO by a sufficiently small positive number (for example, 0.01). The envelope converting unit 32 executes the sound character conversion using the control value Ca[n] not only for the voiced sound period but also for the non-voiced sound period. The same configuration can be adopted for the setting of the control value Cb[n] according to the second embodiment. As understood from the foregoing example, in the third embodiment, the sound process (for example, the sound character conversion or the smoothing process) to which the control value Ca[n] according to the difference between the strengths L1[n] and L2[n] is applied is executed for the voiced sound period. For the non-voiced sound period, the result is comprehensively expressed as a form in which the sound processing suppressed or omitted.

(3) In the above-described embodiments, the sound processing (the sound character conversion and the smoothing process) and the setting of the control value (Ca[n], Cb[n]) have been executed at each analysis time point n. However, a period of the sound processing and a period of the setting of the control value can also be set to be different. For example, the control processing unit 28 can also update the control value (Ca[n], Cb[n]) at a period longer than an interval between analysis time points occurring in succession.

(4) In the above-described embodiments, the configuration in which the smoothing processing unit 34 executes the smoothing process after the envelope converting unit 32 executes the sound character conversion has been exemplified. However, the order of the sound character conversion and the smoothing process can be reversed. That is, the envelope converting unit 32 can also execute the sound character conversion after the smoothing processing unit 34 executes the smoothing process.

(5) A method of calculating the similarity index D (Vb[n], Vb[n−k]) in Equation (2) described above is not limited to the example above described in the embodiments. For example, in the above-described embodiments, the aspect in which the similarity index D (Vb[n], Vb[n−k]) has a smaller numerical value as the spectral envelope Eb[n] is more similar to the spectral envelope Eb[n−k] (hereinafter referred to as an "aspect A") has been exemplified. Here, an aspect in which the similarity index D (Vb[n], Vb[n−k]) is calculated so that the similarity index D (Vb[n], Vb[n−k]) has a larger numerical value as the spectral envelope Eb[n] is more similar to the spectral envelope Eb[n−k] (hereinafter referred to as an "aspect B") is also assumed. For example, in the aspect B, correlation between the spectral envelope Eb[n] and the spectral envelope Eb[n−k] is calculated as the similarity index D (Vb[n], Vb[n−k]). In the aspect B, in a case in which the similarity index D (Vb[n], Vb[n−k]) is greater than the threshold e, the difference (Vb[n]−Vb[n−k]) between the similarity index D (Vb[n], Vb[n−k]) and the threshold e is used as the nonlinear function F[k]. In a case in which the similarity index D (Vb[n], Vb[n−k]) is less than the threshold e, the spectral envelope Eb[n−k] is excluded from the target of the product-sum arithmetic operation of Equation (1).

As understood from the above description, in the epsilon separation type nonlinear filter, while the difference (Vb[n]−Vb[n−k]) is used as the nonlinear function F[k] in regard to the spectral envelope Eb[n−k] in which the similarity index D (Vb[n], Vb[n−k]) is on a similar side to the threshold e, the spectral envelope Eb[n−k] is excluded from the target of the product-sum arithmetic operation in regard to the spectral envelope Eb[n−k] in which the similarity index D (Vb[n], Vb[n−k]) is on a different side (non-similar side) from the threshold e. The "similar side" to the threshold e means a range less than the threshold e in the aspect A and means a range greater than the threshold e in the aspect B. The "different side" from the threshold e means a range greater than the threshold e in the aspect A and means a range less than the threshold e in the aspect B.

(6) The sound processing apparatus 100 can also be realized by a server apparatus communicating with a terminal apparatus (for example, a mobile phone or a smartphone) via a communication network such as a mobile communication network or the Internet. For example, the sound processing apparatus 100 generates the acoustic signal Y through a process on the acoustic signal X received from a terminal apparatus via a communication network and transmits the acoustic signal Y to the terminal apparatus.

(7) As exemplified in the above-described embodiments, the sound processing apparatus 100 is realized by causing the control device 10 to cooperate with a program. A program according to a preferred aspect of the invention causes a computer to function as a smoothing processing unit to which a nonlinear filter that smooths a fine temporal perturbation in a spectral envelope of an acoustic signal on a time axis and suppresses the smoothing on a large temporal change is applied. For example, the above-exemplified program can be provided in a form in which the program is stored in a computer-readable recording medium and can be installed in a computer.

The recording medium is, for example, a non-transitory recording medium. An optical recording medium such as a CD-ROM is a good example, but a recording medium of any known format such as a semiconductor recording medium or a magnetic recording medium can be included. The "non-transitory recording medium" includes all the computer-readable recording media excluding a transitory propagating signal, and a volatile recording medium is not excluded. The program can also be delivered to a computer in a delivery form via a communication network.

(8) For example, the following configurations are ascertained from the above-exemplified embodiments.

<Aspect 1>

In an sound processing method according to a preferred aspect (Aspect 1) of the invention, a computer (a computer system configured with a single computer or a plurality of computers) applies a nonlinear filter to a temporal sequence of spectral envelope of an acoustic signal wherein the nonlinear filter smooths a fine temporal perturbation without smoothing out a large temporal change. In the foregoing aspect, the temporal sequence of spectral envelope of the acoustic signal is smoothed by applying the nonlinear filter to the spectral envelope wherein the nonlinear filter smooths the fine temporal perturbation of the spectral envelope without smoothing out the large temporal change. Accordingly, it is possible to effectively smooth the fine temporal perturbation in the spectral envelope while equally maintain the large temporal change of the spectral envelope to be equal to the temporal change before the smoothing.

<Aspect 2>

In a preferred example (Aspect 2) of Aspect 1, the nonlinear filter is an epsilon separation type nonlinear filter that generate an output spectral envelope corresponding to a first spectral envelope through a product-sum arithmetic operation of calculating a nonlinear function corresponding to each of two or more second spectral envelopes on periphery of the first spectral envelope among a plurality of spectral envelopes calculated at different time points on the time axis, multiplying each of the nonlinear functions by a coefficient and accumulating the products. While a difference between the first and second spectral envelopes is used as the nonlinear function in regard to the second spectral envelope in which a similarity index indicating a degree of similarity to or difference from the first spectral envelope is on a similar side to a threshold among the two or more second spectral envelopes, the second spectral envelope is excluded from a target of the product-sum arithmetic operation in regard to the second spectral envelope in which the similarity index is on a different side from the threshold or a result obtained by suppressing the difference between the first and second spectral envelopes is used as the nonlinear function. In the foregoing aspect, the epsilon separation type nonlinear filter is used to smooth the spectral envelope of the acoustic signal. Accordingly, it is possible to effectively smooth the fine temporal perturbation in the spectral envelope while equally maintain the steep temporal change of the spectral envelope to be equal to the temporal change before the smoothing.

<Aspect 3>

In a preferred example (Aspect 3) of Aspect 2, the threshold is changed. In the foregoing aspect, the threshold applied to the epsilon separation type nonlinear filter is changed. Accordingly, it is possible to variably control the degree of the smoothing of the spectral envelope of the acoustic signal.

<Aspect 4>

According to a preferred aspect (Aspect 4) of the invention, a sound processing apparatus includes a smoothing processor configured to apply a nonlinear filter to a temporal sequence of a spectral envelope of an acoustic signal, wherein the nonlinear filter smooths a fine temporal perturbation of the spectral envelope without smoothing out a large temporal change. In the foregoing aspect, the spectral envelope of the acoustic signal is smoothed on the time axis by applying the nonlinear filter to the spectral envelope, wherein the nonlinear filter performs a smoothing on the fine temporal perturbation and suppresses the smoothing on the large temporal change. Accordingly, it is possible to effectively smooth the fine temporal perturbation in the spectral envelope while equally maintain the large temporal change of the spectral envelope to be equal to the temporal change before the smoothing.

What is claimed is:

1. A sound processing method comprising:

supplying an acoustic signal;

improving a sound quality of the supplied acoustic signal by:

applying a nonlinear filter to a temporal sequence of original spectral envelope of the supplied acoustic signal to smooth fine temporal perturbation of the original spectral envelope without smoothing out a larger temporal change of the original spectral envelope; and adjusting the supplied acoustic signal having the original spectral envelope using a temporal sequence of spectral envelope smoothed by the nonlinear filter to generate an acoustic signal having the spectral envelope in which the fine temporal perturbation has been smoothed; and outputting the acoustic signal having the spectral envelope in which the fine temporal perturbation has been smoothed.

2. The sound processing method according to claim 1, wherein the nonlinear filter is an epsilon separation type nonlinear filter that generates an output spectral envelope corresponding to a first spectral envelope through a product-sum arithmetic operation of calculating a nonlinear function corresponding to each of two or more second spectral envelopes on periphery of the first spectral envelope among a plurality of spectral envelopes calculated at different time points on the time axis, multiplying each of the nonlinear functions by a coefficient and accumulating the products.

3. The sound processing method according to claim 2, wherein for each second spectral envelope, among the two or more second envelopes:

in a case where the second spectral envelope is more similar to the first envelope than a predetermined threshold, then a difference vector between the first and second spectral envelopes is used as the nonlinear function, and in a case where the second spectral envelope is less similar to the first spectral envelope than the threshold, a zero vector or a suppressed vector of the difference is used as the nonlinear function.

4. The sound processing method according to claim 3, wherein the threshold is set to a small numerical value for a period in which the level of the acoustic signal is small.

5. The sound processing method according to claim 1, wherein the nonlinear filter performs a product-sum operation on a spectral envelope at a time point and one or more spectral envelopes near the time point and more similar to the spectral envelope at the time point than a threshold to obtain a smoothed spectral envelope at the time point.

6. A sound processing apparatus comprising:

a sound supplying device that supplies an acoustic signal;

a smoothing processor configured to improve sound quality of the supplied acoustic signal by:

applying a nonlinear filter to a temporal sequence of original spectral envelope of the supplied acoustic signal to smooth fine temporal perturbation of the original spectral envelope without smoothing out a larger temporal change of the original spectral envelope; and adjusting the supplied acoustic signal having the original spectral envelope using a temporal sequence of spectral envelope smoothed by the nonlinear filter to generate an acoustic signal having the spectral envelope in which the fine temporal perturbation has been smoothed; and a sound emitting device that outputs the acoustic signal having the spectral envelope in which the fine temporal perturbation has been smoothed.

* * * * *